US006214529B1

(12) United States Patent
Eikenberry et al.

(10) Patent No.: US 6,214,529 B1
(45) Date of Patent: Apr. 10, 2001

(54) METHOD OF SUPPRESSING FOG IN SILVER HALIDE EMULSIONS

(75) Inventors: Jon N. Eikenberry; Kenneth G. Harbison, both of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/416,822

(22) Filed: Oct. 12, 1999

Related U.S. Application Data

(63) Continuation-in-part of application No. 09/177,220, filed on Oct. 22, 1998, now abandoned.

(51) Int. Cl.[7] ..... G03C 5/18; G03C 5/26

(52) U.S. Cl. ..... 430/449; 430/614; 430/631; 430/546; 430/613; 430/615

(58) Field of Search ..... 430/449, 631, 430/546, 607, 613, 614, 615

(56) References Cited

U.S. PATENT DOCUMENTS

| | | | |
|---|---|---|---|
| 2,870,015 | 1/1959 | Allen et al. . | |
| 4,224,403 | 9/1980 | Toda et al. . | |
| 4,490,462 | 12/1984 | Kawaguchi et al. . | |
| 5,059,516 | 10/1991 | Sato et al. . | |
| 5,445,913 * | 8/1995 | Bailey et al. | 430/546 |
| 5,468,602 | 11/1995 | Takahashi . | |
| 5,968,724 * | 10/1999 | Eikenberry et al. | 430/614 |

OTHER PUBLICATIONS

Japanese Abstract 09–329862.
Japanese Abstract 10–011739.
Japanese Abstract 09–133977.
Research Disclosure No. 37026, Feb. 1995.
Research Disclosure No. 308119, Dec. 1989.

* cited by examiner

*Primary Examiner*—Geraldine Letscher
(74) *Attorney, Agent, or Firm*—Sarah Meeks Roberts

(57) ABSTRACT

This invention relates to a method of reducing fog in a silver halide emulsion comprising taking a high fogging emulsion which has been chemically sensitized and cooled, holding the high fogging emulsion in the form of a melt in preparation for coating on a support, and prior to or during said holding, contacting the emulsion with an isothiazolin-one compound represented by the following formula wherein $R^1$ is a substituent; and Z contains the carbon atoms necessary to form a substituted or unsubstituted non-aromatic ring. It also relates to silver halide photographic elements containing such emulsions.

12 Claims, No Drawings

METHOD OF SUPPRESSING FOG IN SILVER HALIDE EMULSIONS

CROSS REFERENCE TO RELATED APPLICATIONS

This is a continuation-in-part application of Ser. No. 09/177,220 filed Oct. 22, 1998 entitled "A Method of Suppressing Fog in Silver Halide Emulsions" by Eikenber et al. now abandoned.

FIELD OF THE INVENTION

This invention relates to the use of isothiazolin-one compounds with light-sensitive silver halide emulsions.

BACKGROUND OF THE INVENTION

Problems with fogging of silver halide emulsions have plagued the photographic industry from its inception. Fog can be defined as a developed density that is not associated with the action of the image-forming exposure, and is usually expressed as "D-min," the density obtained in the unexposed portions of the emulsion. Density, as normally measured, includes both that produced by fog and that produced as a function of exposure to light. It is known in the art that the appearance of photographic fog related to intentional or unintentional reduction of silver ion can occur during many stages of preparation of the photographic element including silver halide emulsion preparation, spectral/chemical sensitization of the silver halide emulsion, melting and holding of the liquid silver halide emulsion melts, subsequent coating of silver halide emulsions, and prolonged natural and artificial aging of coated silver halide emulsions.

The suppression of fog is, thus, a major concern when dealing with silver halide emulsions. A multitude of compounds involving many different chemical structures have been studied and used for this purpose. Examples can be found in *Research Disclosure* 308119, published December 1989, and include mercaptotetrazoles, benzothiazoles, tetraazaindenes, disulfide compounds, and mercunic chloride to name a few. Despite the large number of materials available, few are able to reduce fog without also reducing speed.

There is an especially great need to control the tendency of emulsions to increase in fog while in the melted state. The demands of mass producing photographic film often require the pre-melting of large quantities of emulsion in preparation for long coating events. Emulsions may be held in the melted state for as long as 16 hours before completion of a particular job. During this period certain emulsions have a propensity to gain fog beyond an acceptable level and, therefore, require the addition of one or more antifoggants.

In this invention it has been discovered that a specific group of isothiazolin-ones is particularly useful in controlling fog which develops during melt-hold. Isothiazolin-ones are known as useful biocides for silver halide photographic elements as described in *Research Disclosure,* 37026, February 1995; in U.S. Pat. Nos. 4,224,403,and 4,490,462; and in JP 09-329862 and JP 10-011739. JP 09-133977 describes one class of isothiazolin-ones as reducing fog when added during precipitation of a silver halide emulsion. However, nowhere has it been recognized or desciubed that a specific group of isothiazolin-ones is useful in reducing the fog which may develop during melt-hold of certain silver halide emulsions.

SUMMARY OF THE INVENTION

This invention provides a method of reducing fog in a silver halide emulsion comprising taking a high fogging emulsion which has been chemically sensitized and cooled, holding the high fogging emulsion in the form of a melt in preparation for coating on a support, and prior to or during said holding, contacting the emulsion with an isothiazolin-one compound represented by the following formula

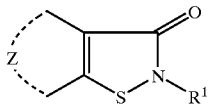

wherein $R^1$ is a substituent, and Z contains the carbon atoms necessary to form a substituted or unsubstituted non-aromatic ling. This invention further provides a silver halide photographic element containing such an emulsion.

The particular isothiazolin-ones used in this invention are uniquely effective at suppressing fog in certain emulsions in the melted state. Not only do the isothiazolin-ones reduce fog, but they do so without reducing fresh speed or the speed observed after the emulsion has been held in the melted state. Other isothiazolin-ones which ale chemically very similar have little or no effect on the fog growth of photographic emulsions held in the melted state.

DETAILED DESCRIPTION OF THE INVENTION

The isothiazolin-one compounds utilized in this invention are represented by the formula

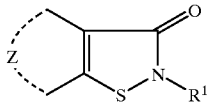

Z contains the carbon atoms necessary to form a substituted or unsubstituted non-aromatic ring. Preferably Z is a substituted or unsubstituted five or six-membered non-aromatic ring, and more prefererably Z is a substituted or unsubstituted five-membered non-aromatic ring. In one suitable embodiment Z is an unsubstituted non-aromatic five-membered ring.

$R^1$ can be any substituent which is suitable for use in a silver halide photographic element and which does not interfere with the fog restraining activity of the isothiazolin-one compound. Preferably $R^1$ is a substituted or unsubstituted aliphatic, aromatic or heterocyclic groups.

When $R^1$ is an aliphatic group, preferably, it is an alkyl group having from 1 to 20 carbon atoms, or an alkenyl or alkynyl group having from 2 to 20 carbon atoms. More preferably, it is an alkyl group having 1 to 6 carbon atoms, or an alkenyl or alkynyl group having 3 to 5 carbon atoms. Most preferably it is an alkyl group having 1 to 3 carbon atoms. These groups may or may not have substituents. Examples of alkyl groups include methyl, ethyl, propyl, butyl, pentyl, hexyl, octyl, 2-ethylhexyl, decyl, dodecyl, hexadecyl, octadecyl, cyclohexyl, isopropyl and t-butyl groups. Examples of alkenyl groups include allyl and butenyl groups and examples of alkynyl groups include propargyl and butynyl groups.

The preferred aromatic groups have from 6 to 20 carbon atoms and include, among others, phenyl and naphthyl groups. More preferably, the aromatic groups have 6 to 10 carbon atoms and most preferably the aromatic groups are phenyl. These groups may be substituted or unsubstituted. The heterocyclic groups are 3 to 15-membered rings or condensed rings with at least one atom selected from nitrogen, oxygen, sulfur, selenium and tellurium. More preferably, the heterocyclic groups are 5 to 6-membered rings with at least one atom selected from nitrogen. Examples of heterocyclic groups include pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings.

Nonlimiting examples of substituent groups for $R^1$ and Z include alkyl groups (for example, methyl, ethyl, hexyl), aryl groups (for example, phenyl, naphthyl, tolyl), acyl groups (for example, acetyl, propionyl, butyryl, valeryl), sulfonyl groups (for example, methylsulfonyl, phenylsulfonyl), ether groups (for example methoxy, ethoxy, propoxy, butoxy), hydroxyl and nitrile groups. Preferred substituents are lower alkyl groups, i.e., those having 1 to 4 carbon atoms (for example, methyl), hydroxyl groups, and halogen groups (for example, chloro).

The isothiazolin-ones may be prepared as described in U.S. Pat. No. 4,708,959—Shroot et al; U.S. Pat. No. 4,851,541—Maignan et al; U.S. Pat. No. 5,082,966—Moffat; U.S. Pat. No. 5,336,777—Moffat et al; and U.S. Pat. No. 5,466,814—Moffat et al, all of which are incorporated herein by reference. Some of them are also available commercially from Zeneca Biocides, Inc., Wilmington, Del. 19850-5457.

It is understood throughout this specification and claims that any reference to a substituent by the identification of a group or a ling containing a substitutable hydrogen (e.g., alkyl, amine, aryl, alkoxy, heterocyclic, etc.), unless otherwise specifically described as being unsubstituted or as being substituted with only certain substituents, shall encompass not only the substituent's unsubstituted form but also its form substituted with any substituents which do not negate the advantages of this invention. Nonlimiting examples of suitable substituents are alkyl groups (for example, methyl, ethyl, hexyl), aryl groups (for example, phenyl, naphthyl, tolyl), acyl groups (for example, acetyl, propionyl, butyryl, valeryl), sulfonyl groups (for example, methylsulfonyl, phenylsulfonyl), alkoxy groups, hydroxy groups, alkylthio groups, arylthio groups, acylamino groups, sulfonylamino groups, acyloxy groups, carboxyl groups, cyano groups, sulfo groups and amino groups.

The isothiazolin-one compounds utilized in this invention are useful in suppressing fog during the melt hold of a certain group of high fogging emulsions. A useful screening procedure for selecting emulsions that will benefit from the addition of the isothiazoin-one compounds (i.e. high fogging emulsions) is as follows:

Melt the fully sensitized emulsion and hold with stilling at 55° C. for 3 hr.

Coat the emulsion in a simple, single layer format with an appropriate colored coupler.

Process in a standard C-41 process and assess densitometry. If the D-min of the sample held at 55° C. for three hours exceeds that observed for a control sample which has not been held, then the emulsion should be treated with the isothiazolin-one compound.

These compounds are particularly useful with photographic emulsions with enhanced sensitivity such as those described by Fenton et. al. in U.S. Pat. No. 5,476,760, and large tabular grain emulsions such as those described by Lin et. al. in U.S. application Ser. No. 08/985,532.

Useful levels of the isothiazolin-one compounds range from about 0.02 to 10 mmol/mol Ag; more preferably 0.05 to 2.0, and most preferably 0.10 to 1.0. The isothiazolin-one compounds may be used in addition to any conventional emulsion stabilizer or antifoggant as commonly practiced in the air. Combinations of more than one isothiazolin-one compound may be utilized.

The photographic emulsions of this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The emulsion is then cooled to about 40° C. or less to stop chemical sensitization. The precipitation and spectral and chemical sensitization methods utilized in preparing the emulsions employed in the invention can be any of those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating. In order to coat the emulsion it must be in the form of a melt. Generally an emulsion will melt at about 40° C. The emulsion might be chemically sensitized, cooled to a normal melt temperature and then coated. More typically, after chemical sensitization the emulsion is chilled to form a solid for storage. When the emulsion is to be coated it is then heated to a melt temperature. Often the emulsion cannot be coated immediately and must be held as a melt for a long period of time. It is during this holding time that fogging problems occur with the high fogging emulsions of the invention. For the purposes of this invention an emulsion is "held" if it is at the melt temperature for more than 30 minutes prior to coating. The compounds of this invention are particularly useful with emulsions held for more than 60 minutes.

The isothiazolin-one compounds may be brought into contact with the silver halide emulsion at any time after the chemically sensitized emulsion has been cooled to stop sensitization and before or during the holding of the emulsion in the form of a melt. Normally they are added directly to the emulsion Preferably the compounds are added prior to or immediately after the start of the holding period. The isothiazolin-one compounds may be added to the photographic emulsion using any technique suitable for this purpose. For example, they may be dissolved in an aqueous solution and added to the emulsion or they may be added to a coupler dispersion which is then combined with the emulsion.

The silver halide emulsions utilized in this invention may be comprised of any halide distribution. Thus, they may be comprised of silver bromoiodide, silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions.

The silver halide emulsions can contain grains of any size and morphology as long as the emulsion is a high fogging emulsion. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements suitable for use with this invention may be simple single layer elements or multilayer, multicolor elements. They may also be black and white elements. Multicolor elements contain dye image-forming units sensitive to each of the three primary regions of the visible light spectrum. Each unit can be comprised of a single emulsion layer or of multiple emulsion layers sensitive to a given region of the spectrum. The layers of the element, including the layers of the image-forming units, can be arranged in various orders as known in the art. The silver halide elements may be reversal or negative elements, or transmission or reflection elements(including color paper).

A typical multicolor photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like.

The photographic elements may also contain a transparent magnetic recording layer such as a layer containing magnetic particles on the underside of a transparent support, as described in *Research Disclosure, November* 1992, Item 34390 published by Kenneth Mason Publications, Ltd., Dudley Annex, 12a North Street, Emswoith, Hampshire PO10 7DQ, ENGLAND. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in *Research Disclosure*, June 1994, Item 36230 published by Kenneth Mason Publications, Ltd., Dudley Annex, 12a North Street, Emsworth, Hampshire PO 10 7DQ, ENGLAND, and such as the Advanced Photo System, particularly the Kodak ADVANTIX films or cameras.

In the following Table, reference will be made to (1) *Research Disclosure*, December 1978, Item 17643, (2) *Research Disclosure*, December 1989, Item 308119, (3) *Research Disclosure*, September 1994, Item 36544, and (4) *Research Disclosure*, September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure*, February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation including |
| 3 & 4 | I, II, III, IX A & B | hardeners, coating aids, addenda, etc. |
| 1 | III, IV | Chemical sensitization and |
| 2 | Ill, IV | spectral sensitization/ |
| 3 & 4 | IV, V | desensitization |
| 1 | V | UV dyes, optical |
| 2 | V | brighteners, luminescent |
| 3 & 4 | VI | dyes |
| 1 | VI | Antifoggants and |
| 2 | VI | stabilizers |
| 3 & 4 | VII | |
| 1 | VIII | Absorbing and scattering |
| 2 | VIII, XIII, XVI | materials; Antistatic layers; matting agents |
| 3 & 4 | VIII,IX C & D | |
| 1 | VII | Image-couplers and image- |
| 2 | VII | modifying couplers; Wash- |
| 3 & 4 | X | out couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII,XIX, XX | |
| 3 & 4 | XIV | Scanning and digital processing procedures |

The photographic elements can be incorporated into exposure structures intended for repeated use or exposure structures intended for limited use, variously referred to as single use cameras, lens with film, or photosensitive material package units.

The photographic elements can be exposed with various forms of energy which encompass the ultraviolet, visible, and infrared regions of the electromagnetic spectrum as well as the electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements. The photographic elements are preferably exposed to actinic radiation, typically in the visible region of the spectrum, to form a latent image, and then processed to form a visible image, preferably by other than heat treatment.

The following examples illustrate the practice of this invention. They are not intended to be exhaustive of all possible variations of the invention.

EXAMPLES

Emulsion Preparation

Emulsion 1

This is a tabular, run/dump, bromoiodide emulsion in which the first portion of iodide is added simultaneously with bromide and the second iodide addition is done abruptly by dumping into the reaction vessel a silver iodide seed emulsion and then performing a silver over-run. The procedure is based on that described in U.S. application Ser. No. 08/985,532 for Emulsion E. A 0.25 M silver nitrate solution was added at the rate of 35 mL/min for 15 min into a reaction vessel with good stilling and containing 18.4 g of oxidized, lime-processed, bone gelatin, 33.2 g sodium bromide, and antifoamant in 4.6 L of distilled water maintained at 58° C. Following nucleation, an ammonia digest was performed with 0.025 moles of ammonia at pH 10 for 5 min. An additional 222 g of oxidized, lime-processed, bone gelatin together with additional antifoamant in 2.4 L of distilled water was added and the pH was adjusted to 5.5. Growth was conducted over a period of 46 min by the equimolar addition of 3.0 M silver nitrate with $NaBr_{0.99}I_{0.01}$ in a double-jet mode maintaining a pBr of 1.70. The silver flow rate was ramped during this time from 7.4 to 170.5 mL/min delivering 68% of the total silver for the make. During this growth period 36 mg/Ag mol $K_4Ru(CN)_6$ was delivered to the reaction vessel in 1 min when 33% of the total silver had been delivered. 70 $\mu$g/Ag mol of KSeCN was added followed by 3.0 M $NaBr_{0.99}I_{0.01}$ at the rate of 200 mL/min for 2 min. 0.38 mol of silver iodide seeds was added and then a silver over-run was performed by adding 3.0 M silver nitrate at the rate of 50 mL/min for 24 min. A balancing flow of 3.0 M NaBr was used to limit the drop in bromide concentration to a pBr of 2.46. Excess salt was removed by ultrafiltration to yield 12.6 moles of emulsion containing an average of 3.8% iodide with a grain size of 2.8×0.106 $\mu$m.

Emulsion 2

This emulsion is a larger version of Emulsion 1 made in an identical fashion with the following exceptions:

the nucleating silver solution was 0.21 M.

the emulsion make temperature was 66° C.

7.6 g of NaBr was added with the gelatin following nucleation.

the growth pBr was 1.55.

the silver over-run began 74% into the make.

The emulsion contained an average of 3.9% iodide with a grain size of 3.97×0.129 $\mu$m.

Emulsion 3

This is a tabular, structured bromoiodide emulsion in which the iodide is added as a $NaBr_{0.50}I_{0.50}$ solution at 70% of the total silver just prior to performing a silver over-run. The emulsion was prepared in the presence of growth modifier, Pluronic-31R1™, to produce grains of a uniform size. The procedure is based on that described by Fenton et. al. in U.S. Pat. No. 5,476,760. A 0.35 M silver nitrate solution was added at the rate of 65 mL/min for 1 min into a reaction vessel with good stilling and containing 2.52 g of oxidized, lime-processed, bone gelatin, 0.012 M sodium bromide, and 1.56 g of Pluronic-31R1™ in 4.5 L of distilled water maintained at 45° C. Following nucleation the temperature was raised to 60° C., the bromide concentration was raised to a pBr of 1.48 by adding 2.5 M NaBr, and an ammonia digest was performed with 0.077 moles of ammonia at pH 11.6 for 9 min. An additional 150 g of oxidized, lime-processed, bone gelatin together with 0.26 g of additional growth modifier in 1.5 L of distilled water was added, the pH was adjusted to 5.7, and the salt content was raised to a pBr of 1.36 by adding 2.5 M NaBr. Growth was begun by adding 0.35 M silver nitrate at rate of 14.5 mL/min and linearly increasing the rate to 60 mL/min over a period of 10.4 min. Following a 1 min hold, growth was resumed with the addition of 0.35 M silver nitrate ramping the flow linearly from 60 to 85 mL/min over a period of 15.8 min while maintaining a pBr of 1.61 with the balanced flow of 2.5 M NaBr in a double-jet mode. The bromide concentration was raised to a pBr of 1.48 with 2.5 M NaBr and growth was resumed maintaining this pBr by the addition of 2.4 M silver nitrate at a flow rate of 12.4 and increasing linearly to 66.7 mL/min over a period of 70.24 min while delivering a balanced flow of 2.5 M NaBr. At this point 68% of the total silver for the make had been delivered. The silver and salt flows were then maintained for 1 min at their final settings while 21 mg/Ag mol $K_4Ru(CN)_6$ was added. 50 g of lime-processed, bone gelatin in 0.5 L of distilled water was then added followed by 1 M $NaBr_{0.50}I_{0.50}$ delivered at a rate of 45 mL/min for 17.5 min. After a 2 min hold, 2.4 M silver nitrate was added at the rate of 37.5 mL/min simultaneously with 2.5 M NaBr at a rate of 20 mL/min for 35.33 min bringing the pBr to approximately 3. Excess salt was removed by ultrafiltration to yield 12 moles of emulsion containing an average of 3.8% iodide with a grain size of 2.85×0.116 $\mu$m.

Emulsion 4a

This is a high iodide core, polymorphous emulsion prepared using a thiocyanate digest as follows: Into a reaction vessel with good mixing was added 6.8 L of distilled water, 196 g of lime-processed, bone gelatin, 233.2 g of sodium bromide, 34 g of potassium iodide and antifoamant and, while keeping the temperature at 53° C., an aqueous solution consisting of 1.405 M silver nitrate was added at the rate of 125 mL/min for 23.46 min simultaneously with the addition of a solution consisting of 2.466 M sodium bromide and 0.154 M potassium iodide added at the rate of 141.7 mL/min. The addition of halide solution was then terminated and the addition of silver nitrate solution was continued for an additional 23.46 min. The vessel temperature was raised to 76° C. over a period of 11.5 min and an aqueous solution of 19 g of sodium thiocyanate in 28 mL was then added. After a hold time of 25 min the vessel was cooled to 45° C. and the excess salts were removed by ultrafiltration. The yield was 8.24 moles of a polymorphic emulsion containing 8.9% iodide and with an average size of 1.04 $\mu$m.

Emulsions 4b,4c,4d, and 4e

These emulsions are repeat makes of Emulsion 4a and were prepared in an identical manner to Emulsion 4a.

Emulsion 5

This is a tabular, run/dump, bromoiodide emulsion in which the first portion of iodide is added simultaneously with bromide and the second iodide addition is done abruptly by dumping into the reaction vessel a silver iodide seed emulsion and then performing a silver over-run. It was prepared according to the procedure described by Wightman and Johnson in U.S. Pat. No. 5,061,616. A 2.75 M silver nitrate solution was added simultaneously in a double-jet mode with an equimolar $NaBr_{0.985}I_{0.015}$ at the rate of 35 mL/min for 1.25 min into a reaction vessel with good stirring and containing 10 g of lime-processed, bone gelatin, 0.05749 M sodium bromide, and an antifoamant in 5 L of distilled water maintained at 75° C. Following nucleation, an ammonia digest was performed with 0.06 moles of ammonia at pH 10 for 10 min. An additional 140 g of oxidized, lime-processed, bone gelatin together with additional antifoamant in 1.5 L of distilled water was added and the pH was adjusted to 6. Growth was conducted over a period of 61 min by the equimolar addition of 2.75 M silver nitrate with $NaBr_{0.985}I_{0.015}$ in a double-jet mode maintaining a pBr of 1.36. The flow rates were ramped during this time from 15 to 100 mL/min delivering 70% of the total silver for the make. 6 μg/Ag mol of $K_2IrCl_6$ and 200 μg/Ag mol of KSeCN were added followed by 728 mL of 2.6 M sodium bromide and 0.36 mol of silver iodide seeds. 2.75 M silver nitrate was added at the rate of 50 mL/min for 5.23 min bringing the pBr to approximately 2.29. Excess salt was removed by ultrafiltration to yield 12 moles of emulsion containing an average of 4. 1% iodide with a grain size of 3.07×0.116 μm.

Emulsion 6

This is a tabular, run only, bromoiodide emulsion similar to Emulsion 5 except the second abrupt iodide addition is omitted, the run iodide was added as $NaBr_{0.96}I_{0.04}$, and minor adjustments were made to obtain a smaller grain with a similar thickness. A 2.75 M silver nitrate solution was added simultaneously in a double-jet mode with an equimolar $NaBr_{0.96}I_{0.04}$ at the rate of 35 mL/min for 1.25 min into a reaction vessel with good stirring and containing 10 g of lime-processed, bone gelatin, 0.05749 M sodium bromide, and an antifoamant in 5 L of distilled water maintained at 50° C. Following nucleation, an ammonia digest was performed with 0.10 moles of ammonia at pH 10 for 10 min. An additional 140 g of oxidized, lime-processed, bone gelatin together with additional antifoamant in 1.5 L of distilled water was added and the pH was adjusted to 6. Growth was conducted over a period of 61 min by the equimolar addition of 2.75 M silver nitrate with $NaBr_{0.96}I_{0.04}$in a double-jet mode maintaining a pBr of 1.76. The flow rates were ramped during this time from 15 to 100 mL/min delivering 70% of the total silver for the make. 6 μg/Ag mol of $K_2IrCl_6$ and 200 μg/Ag mol of KSeCN were added followed by 728 mL of 2.6 M sodium bromide. 2.75 M silver nitrate was added at the rate of 50 mL/min for 5.23 min bringing the pBr to approximately 2.60. Excess salt was removed by ultrafiltration to yield 12 moles of emulsion containing an average of 2.8% iodide with a grain size of 1.84×0.12 μm.

Emulsion 7

This is a pure bromide emulsion prepared with growth modifier, Pluronic-31R1™, to produce grains with low size dispersity by techniques previously described by Tsaur et al in U.S. Pat. No. 5,147,771, 2, and 3; U.S. Pat. Nos. 5,171, 659; 5,210,013; and 5,252,453. Into a reaction vessel with good mixing was added 5.95 L of distilled water, 3 g of oxidized, lime-processed, bone gelatin, 3.76 g of sodium bromide, and 0.29 g of Pluronic-31™. While keeping the temperature at 30° C., an aqueous solution consisting of 0.35 M of silver nitrate was added at the rate of 14.3 mL/min simultaneously with the addition of a solution consisting of 0.35 M of sodium bromide at the rare of 14.3 mL/min. The vessel temperature was raised to 60° C. over a period of 18 min, 100 g of oxidized, lime-processed, bone gelatin with 0.068 g Pluronic-31™ in 1.5 L of distilled water was added, and the pH was then adjusted to 5.4. Growth was initiated with a 0.35 M silver nitrate solution added at the rate of 14.3 mL/min simultaneously with a 0.35 M sodium bromide solution added at such a rate as to maintain the pBr at 1.73. Throughout the growth segments, sodium bromide flow was always balanced against the silver nitrate flow to maintain a pBr of 1.73. During the following 15 min, the flow of silver nitrate was increased to 57.2 mL/min. A silver nitrate solution of 1.6 M was then added simultaneously with a 1.679 M sodium bromide at an increasing rate beginning at 12.3 mL/min and ending at 70 mL/min over a period of 70 min. The flow of silver nitrate was then continued for an additional 20.24 min at 70 mL/min with a balanced flow of sodium bromide. The emulsion was then cooled to 45° C. and excess salt removed by ultrafiltration. The total yield was 7.06 moles of a tabular emulsion with a size of 4.80×0.070 μm.

Sample Preparation

Sample 1 (Comparison)

Emulsion 1 was treated sequentially with sodium thiocyanate, finish modifier, FM; spectral sensitizing dyes, SD-1 and SD-2 which constitute spectral sensitization Cyan-1; gold sensitizer, GS; and sodium thiosulfate. It then was heated to 61° C. for 8 min, cooled to 40° C., and antifoggant AF-1 was added.

Sample 2 (Invention)

Sample 1 was treated with 70 mg/Ag mol of Ia.

Sample 3 (Comparison)

Emulsion 2 was treated identically to Sample 1 except for the following:

SD-3 was substituted for SD-1 to give spectral sensitization Cyan-2.

the digest was performed at 65° C. for 5 min.

Sample 4 (Comparison)

Sample 3 was treated with 10 mg/Ag mol II.

Sample 5 (Comparison)

Sample 3 was treated with 100 mg/Ag mol III.

Sample 6 (Comparison)

Sample 3 was treated with 100 mg/Ag mol IV.

Sample 7 (Invention)

Sample 3 was treated with 100 mg/Ag mol Ia.

Sample 8 (Invention)

Sample 3 was treated with 100 mg/Ag mol Ia which had been purified by liquid chromatography.

Sample 9 (Comparison)

Emulsion 3 was treated sequentially with sodium thiocyanate; magenta sensitizing dyes, SD-4 and SD-5; gold sensitizer, GS; sodium thiosulfate; finish modifier, FM; then heated to 65° C. for 11 min, cooled to 40° C., and treated with antifoggant, AF-1.

Sample 10 (Comparison)

Sample 9 was treated with 100 mg/Ag mol II.

Sample 11 (Comparison)

Sample 9 was treated with 100 mg/Ag mol III.

Sample 12 (Comparison)

Sample 9 was treated with 100 mg/Ag mol IV.

Sample 13 (Invention)

Sample 9 was treated with 100 mg/Ag mol Ia.

Sample 14 (Comparison)

Emulsion 4a was treated sequentially with potassium chloride; sodium thiocyanate; finish modifier FM; yellow sensitizing dye, SD-6; gold sulfide; sulfur sensitizer, SS, as described in U.S. Pat. No. 4,810,626; gold sensitizer, GS; and latent image doctor, LID-1, as described in U.S. Pat. No. 4,378,426. The emulsion was then heated to 62° C. for 12 min, cooled to 40° C., and treated with antifoggants, AF-2 and AF-1 respectively.

Sample 15 (Comparison)

Sample 14 was treated with 10 mg/Ag mol II.

Sample 16 (Invention)

Sample 14 was treated with 70 mg/Ag mol Ia.

Sample 17 (Comparison)

Emulsion 4b was sensitized identically to Sample 14.

Sample 18 (Comparison)

Sample 17 was treated with 10 mg/Ag mol II.

Sample 19 (Invention)

Sample 17 was treated with 70 mg/Ag mol Ia.

Sample 20 (Comparison)

Emulsion 4c was sensitized identically to Sample 14.

Sample 21 (Comparison)

Sample 20 was treated with 10 mg/Ag mol II.

Sample 22 (Invention)

Sample 20 was treated with 70 mg/Ag mol Ia.

Sample 23 (Comparison)

Emulsion 4d was sensitized identically to Sample 14.

Sample 24 (Comparison)

Sample 23 was treated with 10 mg/Ag mol II.

Sample 25 (Invention)

Sample 23 was treated with 70 mg/Ag mol Ia.

Sample 26 (Comparison)

Sample 9 was treated with 5 mg/Ag mol of disulfide DS-1.

Sample 27 (Comparison)

Emulsion 4e was sensitized in an identical manner to Sample 14.

Sample 28 (Comparison)

Sample 27 was treated with 25 mg/Ag mot of disulfide, DS-2.

Sample 29 (Comparison)

Sample 27 was treated with 70 mg/Ag mol Ia.

Sample 30 (Comparison)

Emulsion 5 was treated sequentially with sodium thiocyanate; finish modifier, FM, yellow sensitizing dyes, SD-6 and SD-7, antifoggant, AF-2; gold sensitizer, GS; sodium thiosulfate; then was heated to 66° C. for 5 min, cooled to 40° C., and treated with latent image doctor, LID-1; gold sulfide; and antifoggant, AF-1.

Sample 31 (Invention)

Sample 30 was treated with 70 mg/Ag mol of Ia.

Sample 32 (Comparison)

Emulsion 6 was treated sequentially with sodium thiocyanate; finish modifier, FM; yellow sensitizing dyes, SD-6 and SD-7; antifoggant, AF-2; gold sensitizer, GS, sodium thiosulfate; then was heated to 67° C. for 5 min, cooled to 40° C., and treated with latent image doctor, LID-1; gold sulfide; and antifoggant, AF-1.

Sample 33 (Comparison)

Sample 32 was treated with 70 mg/Ag mol of Ia.

Sample 34 (Comparison)

Emulsion 7 was treated sequentially with sodium thiocyanate; finish modifier, FM; spectral sensitizing dye, SD-6; antifoggant, AF-3, as described in U.S. Pat. No. 5,576,170; gold sulfide; latent image doctor, LID-2, as described in U.S. Pat. No. 5,500,333; gold sensitizer, GS; sodium thiosulfate; then was heated to 64° C. for 10 min, cooled to 40° C., and treated with antifoggant, AF-1.

Sample 35 (Comparison)

Sample 34 was treated with 70 mg/Ag mol of Ia.

Photographic Evaluation

The sensitized emulsion samples were coated in a simple single layer format which consisted of a pad of gelatin on a cellulose acetate film support with an antihalation backing covered by a layer containing the emulsion and the yellow image forming coupler, C-1, together with a yellow development inhibitor releasing coupler, C-2. The emulsion layer was protected from abrasion by a gelatin overcoat containing hardener. A detailed description of the layered structure is described below.

| Single Layer Format | |
|---|---|
| Coated Layer | Composition |
| Protective Overcoat | 2.15 g/m$^2$ gelatin |
| Emulsion/Coupler | 3.23 g/m$^2$ gelatin<br>0.86 mg/m$^2$ Ag<br>1.08 g/m$^2$ coupler C-1<br>0.3 g/m$^2$ coupler C-2<br>0.004 g/m$^2$ antifoggant AF-1 |
| Gelatin Pad | 4.89 g/m$^2$ gelatin |
| Support | Cellulose Acetate |

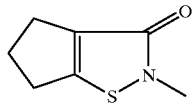

Ia

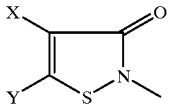

X, Y = H, Cl 75%/H, H 24%/Cl, Cl 1%

II

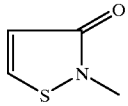

III

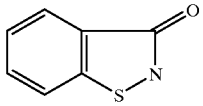

IV

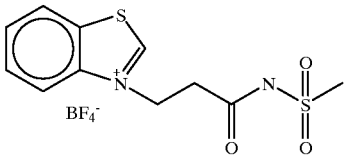

FM $Na_3Au(S_2O_3)_2$

GS

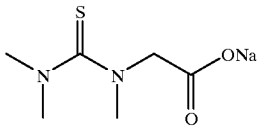

SS

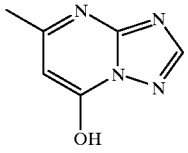

AF-1

-continued
Single Layer Format
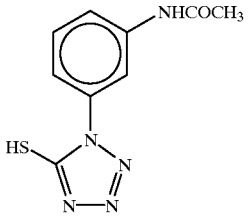
AF-2
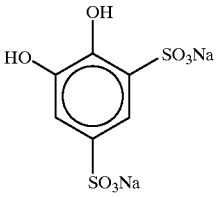
AF-3
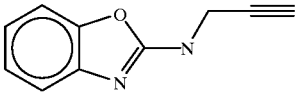
LID-1
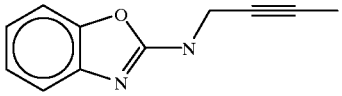
LID-2
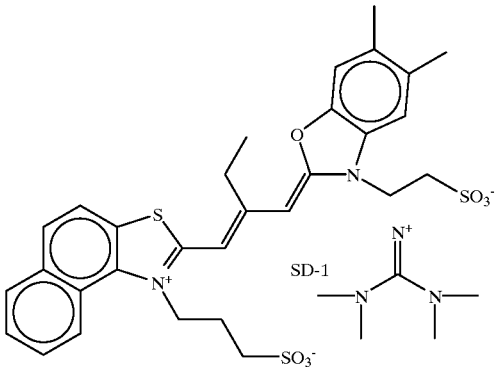
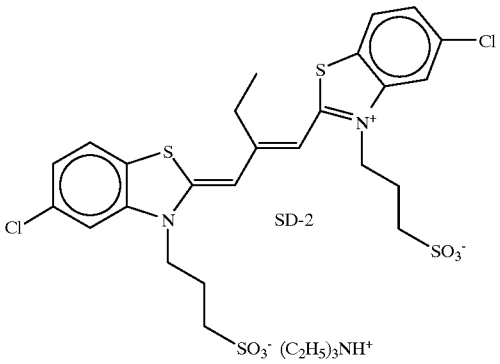
-continued
Single Layer Format
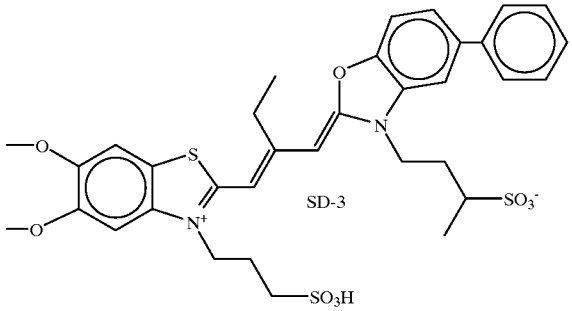
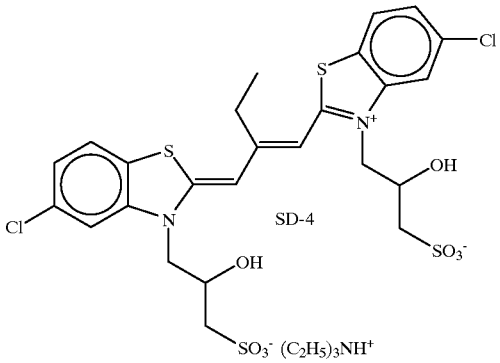
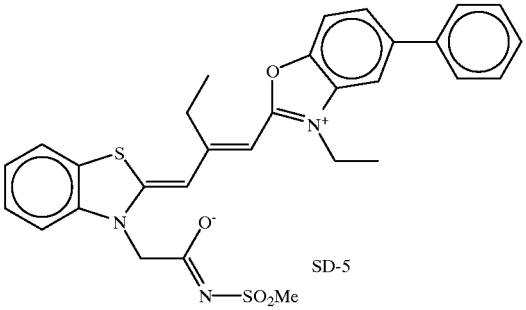
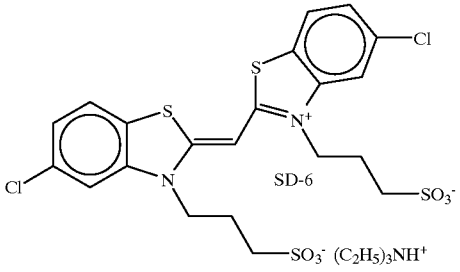

-continued

Single Layer Format

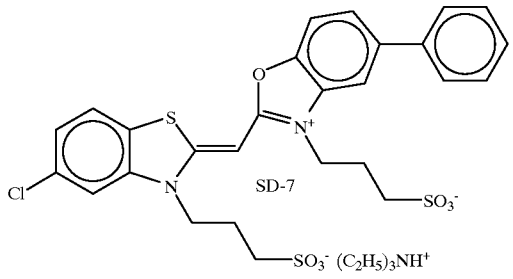

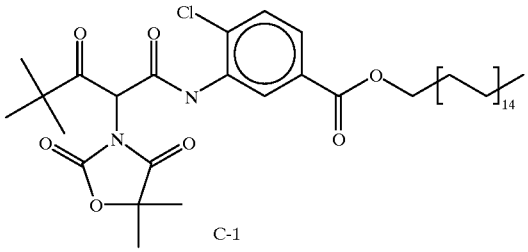

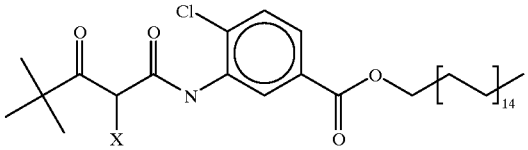

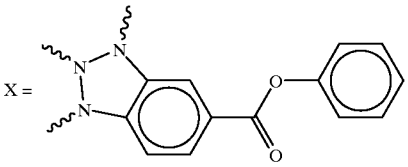

C-2

EXAMPLE 1

This example demonstrates that a tabular grain emulsion which had been chemically and spectrally sensitized for use in the red color record showed a substantial increase in fog and speed loss when held in the melted state at 55° C. for 3 hours (Comparative Sample 1 in Table 1). However when the emulsion was treated with Ia prior to being held in the liquid state, the fog increase and speed loss were greatly reduced (Invention Sample 2). Furthermore, a larger version of the same emulsion when treated with II, III, or IV prior to being held at 55° C. showed little improvement in fog gain or speed loss when compared to the untreated control (Samples 4–6, Table 1). However, when the emulsion was treated with Ia, a substantial improvement in D-min and speed was observed (Sample 7, Table 1). When the emulsion was treated with a purified sample of Ia (Sample 8, Table 1), the response was much the same as the unpurified sample (Sample 7) confirming that the effect is indeed due to the isothiazolin-one and not to an impurity.

The level of II tested in this and most other examples contained herein is approximately one-seventh that of the other isothiazolin-ones because it is generally regarded as more reactive and when tested at the same level as Ia, III, or IV increased speed loss (Sample 10, Table 2) relative to the control.

TABLE 1

Effect of Isothiazolin-ones on Emulsions 1 and 2 Held in the Liquid State at 55° C. for 3 Hours.

| Sample | Emulsion | Spectral Sensitivity | Isothiazolin-one/ (mg/Ag mol) | D-min Change | Speed Change |
|---|---|---|---|---|---|
| 1 Comparison | 1 | Cyan-1 | Control/0 | 0.20 | −12 |
| 2 Invention | 1 | Cyan-1 | Ia/70 | 0.10 | −7 |
| 3 Comparison | 2 | Cyan-2 | Control/0 | 0..12 | −14 |
| 4 Comparison | 2 | Cyan-2 | II/10 | 0..11 | −15 |
| 5 Comparison | 2 | Cyan-2 | III/70 | 0.09 | −14 |
| 6 Comparison | 2 | Cyan-2 | IV/70 | 0.09 | −11 |
| 7 Invention | 2 | Cyan-2 | Ia/70 | 0.03 | −1 |
| 8 Invention | 2 | Cyan-2 | Ia/70 Purified | 0.03 | −2 |

Note: D-min is the minimum optical density measured in an unexposed region of the film. Speeds were measured as 100(1-logH) where H is the exposure in lux-sec necessary to produce a density 0.15 above D-min. D-min and Speed Changes were measured relative to an emulsion sample that had not been held in the liquid state for any significant amount of time.

EXAMPLE 2

Ia is also effective with another tabular grain emulsion having a different iodide and sensitized magenta as shown in Table 2. Although III and IV do reduce the D-min change when Emulsion 3 is held at an elevated temperature, D-min increases and speed losses are not eliminated as when the emulsion is treated with Ia (Samples 11, 12, and 13 in Table 2).

TABLE 2

Effect of Isothiazolin-ones on Emulsion 3 Held in the Liquid State at 50° C. for 3 Hours.

| Example | Emulsion | Spectral Sensitivity | Isothiazolin-one/Level (mg/Ag mol) | D-min Change | Speed Change |
|---|---|---|---|---|---|
| 9 Comparison | 3 | Magenta | Control/0 | 0.09 | −8 |
| 10 Comparison | 3 | Magenta | II/100 | 0.09 | −15 |
| 11 Comparison | 3 | Magenta | III/100 | 0.04 | −9 |
| 12 Comparison | 3 | Magenta | IV/100 | 0.04 | −5 |
| 13 Invention | 3 | Magenta | Ia/100 | 0.00 | 3 |

EXAMPLE 3

Repeat makes of the same yellow sensitized high iodide core emulsion were treated with II and Ia confirming the consistency of Ia as opposed to II in removing excessive D-min growth and speed loss following a melt hold (Table 3).

The effect of Ia was compared with that of two different compounds belonging to the disulfide group which is recognized as furnishing addenda effective at controlling fog. Disulfide, DS-1, is an expected degradation product from the decomposition of Ia and, in fact, was isolated and purified from a commercial sample of Ia. Disulfide, DS-2, is a known fog suppressant (Budz et al, U.S. Pat. No. 5,418,127). The effect of DS-1 and DS-2 at controlling the increase in D-min and loss of speed is shown in Table 4. Clearly neither equals Ia in its ability to repress fog and maintain speed through a period of heating. Higher levels of DS-1 and DS-2 were not examined for reasons shown in Table 5 which catalogs the fresh photographic response of the examples in Table 4. DS-1 caused an objectionable loss in gamma (Sample 26, Table 5) while DS-2 not only reduced gamma by 14% but caused a fresh speed loss of 5 units (Sample 28).

DS-1

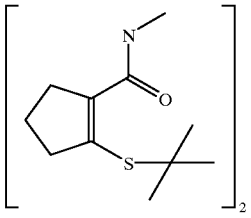

DS-2

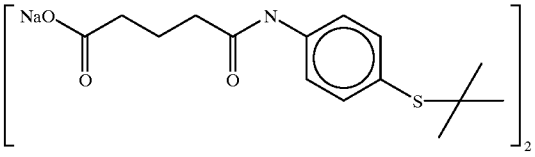

The data in Table 5 illustrate another useful feature of Ia, namely, the lack of an effect on the fresh photographic response of a variety of emulsions. Thus, although DS-2 (Sample 28, Table 4) might be considered a moderately useful fog suppressant, it's effect on fresh speed and gamma would make it unusable for applications involving a high demand for photographic speed.

TABLE 3

Effect of Isothiazolin-ones on Different Batches of Emulsion 4 Held in the Liquid State at 50° C. for 3 Hours.

| Example | Emulsion | Spectral Sensitivity | Isothiazolin-one/Level (mg/Ag mol) | D-min Change | Speed Change |
|---|---|---|---|---|---|
| 14 Comparison | 4a | Yellow | Control/0 | 0.15 | −16 |
| 15 Comparison | 4a | Yellow | II/10 | 0.16 | −19 |
| 16 Invention | 4a | Yellow | Ia/70 | 0.01 | 0 |
| 17 Comparison | 4b | Yellow | Control/0 | 0.13 | −18 |
| 18 Comparison | 4b | Yellow | II/10 | 0.16 | −18 |
| 19 Invention | 4b | Yellow | Ia/70 | 0.00 | 3 |
| 20 Comparison | 4c | Yellow | Control/0 | 0.14 | −17 |
| 21 Comparison | 4c | Yellow | II/10 | 0.16 | −19 |
| 22 Invention | 4c | Yellow | Ia/70 | 0.00 | 1 |
| 23 | 4d | Yellow | Control/0 | 0.12 | −12 |

TABLE 3-continued

Effect of Isothiazolin-ones on Different Batches of Emulsion 4 Held in the Liquid State at 50° C. for 3 Hours.

| Example | Emulsion | Spectral Sensitivity | Isothiazolin-one/Level (mg/Ag mol) | D-min Change | Speed Change |
|---|---|---|---|---|---|
| Comparison 24 | 4d | Yellow | II/10 | 0.13 | −14 |
| Comparison 25 Invention | 4d | Yellow | Ia/70 | 0.01 | −1 |

Note: Emulsions 4a—4d represent repeat makes of the same emulsion

TABLE 4

Comparison of Disulfide and Isothiazolin-ones Effect on Emulsions 3 and 4 Held in the Liquid State at 50° C. for 3 Hours.

| Example | Emulsion | Spectral Sensitivity | Addenda/Level (mg/Ag mol) | D-min Change | Speed Change |
|---|---|---|---|---|---|
| 9 Comparison | 3 | Magenta | Control/0 | 0.09 | −8 |
| 26 Comparison | 3 | Magenta | Disulfide DS-1/5 | 0.09 | −10 |
| 13 Invention | 3 | Magenta | Ia/70 | 0.00 | 3 |
| 27 Comparison | 4e | Yellow | Control/0 | 0.11 | −12 |
| 28 Comparison | 4e | Yellow | Disulfide DS-2/25 | 0.00 | −5 |
| 29 Invention | 4e | Yellow | Ia/70 | 0.00 | 3 |

TABLE 5

Comparison of Disulfide and Isothiazolin-ones Effect on the Fresh Response of Emulsions 3 and 4.

| Sample | Emulsion | Addenda/ Level (mg/Ag mol) | D-min Change | Speed Change | % Change in Gamma |
|---|---|---|---|---|---|
| 9 Comparison | 3 | Control/0 | NA | NA | NA |
| 26 Comparison | 3 | Disulfide DS-1/5 | 0.02 | −2 | −12 |
| 13 Invention | 3 | Ia/70 | 0.00 | −1 | −2 |
| 27 Comparison | 4e | Control/0 | NA | NA | NA |
| 28 Comparison | 4e | Disulfide DS-2/25 | 0.04 | −5 | −14 |
| 29 Invention | 4e | Ia/70 | 0.00 | 1 | −4 |

Note: The D-min, Speed, and Gamma changes are measured against the fresh control. Gamma is defined as the maximum slope in the Density vs. Log Exposure curve.

EXAMPLE 4

Although Ia is useful for a variety of emulsions, it does not add benefit to all emulsions. Three different kinds of tabular emulsions which showed little D-min gain after being held in liquid form, showed no benefit from the addition of Ia and one emulsion (Sample 35, Table 6) increased in fog and speed loss during melt hold as a result of Ia treatment.

Therefore it is demonstrated that an unexpected and very useful photographic effect is provided by the isothiazolin-ones of this invention for emulsions that suffer from substantial fog growth and/or speed loss following melt hold. Furthermore, the compounds of this invention appear unique in their ability to bring about the stabilization of certain emulsions since similar isothiazolin-ones fail to do so.

TABLE 6

Effect of Ia on Various Photographic Emulsions Held in the Liquid State.

| Example | Emulsion | Spectral Sensitivity | Addenda/Level (mg/Ag mol) | D-min Change | Speed Change |
|---|---|---|---|---|---|
| 30 Comparison | 5 | Yellow | Control/0 | 0.03 | 1 |
| 31 Comparison | 5 | Yellow | Ia/70 | 0.03 | 0 |
| 32 Comparison | 6 | Yellow | Control/0 | 0.00 | −6 |
| 33 Comparison | 6 | Yellow | Ia/700 | 0.01 | −4 |
| 34 Comparison | 7 | Yellow | Control/0 | 0.00 | −7 |
| 35 Comparison | 7 | Yellow | 1a/70 | 0.12 | −12 |

The melt holds for Examples 30 and 31 were done at 45° C. for 6 hr., those for Examples 32–35 were done at 50° C. for 3 hr.

The invention has been described in detail with particular reference to certain preferred embodiments thereof, but it will be understood that variations and modifications can be effected within the spirit and scope of the invention.

What is claimed is:

1. A method of reducing fog in a silver halide emulsion comprising taking a high fogging emulsion which has been chemically sensitized and cooled, holding the high fogging emulsion in the form of a melt in preparation for coating on a support, and prior to or during said holding, contacting the emulsion with an isothiazolin-one compound represented by the following formula

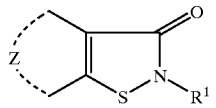

wherein $R^1$ is a substituent; and Z contains the carbon atoms necessary to form a substituted or unsubstituted non-aromatic ring.

2. The method of claim 1 wherein Z contains the carbon atoms necessary to form a substituted or unsubstituted five or six-membered non-aromatic ring.

3. The method of claim 2 wherein Z contains the carbon atoms necessary to form a substituted or unsubstituted five-membered non-aromatic ring.

4. The method of claim 1 wherein $R^1$ is a hydrogen atom or a substituted or unsubstituted aliphatic, aromatic or heterocyclic group.

5. The method of claim 2 wherein $R^1$ is a hydrogen atom or a, substituted or unsubstituted aliphatic, aromatic or heterocyclic group.

6. The method of claim 1 wherein $R^1$ is a hydrogen atom or a substituted or unsubstituted alkyl group having 1 to 6 carbon atoms, a substituted or unsubstituted aryl group having 6 to 10 carbon atoms or a substituted or unsubstituted 5 to 6-membered heterocyclic ring.

7. The method of claim 2 wherein $R^1$ is a hydrogen atom or a substituted or unsubstituted alkyl group having 1 to 6 carbon atoms, a substituted or unsubstituted aryl group having 6 to 10 carbon atoms or a substituted or unsubstituted 5 to 6-membered heterocyclic ring.

8. The method of claim 3 wherein $R^1$ is a hydrogen atom or a substituted or unsubstituted alkyl group having 1 to 6 carbon atoms.

9. The method of claim 1 wherein the emulsion is held in the melt form for more than 60 minutes.

10. The method of claim 2 wherein the emulsion is held in the melt form for more than 60 minutes.

11. The method of claim 3 wherein the emulsion is held in the melt form for more than 60 minutes.

12. The method of claim 1 wherein the isothiazolin-one compound is added prior to holding the emulsion.

* * * * *